US005360516A

United States Patent [19]

Cutright et al.

[11] Patent Number: 5,360,516

[45] Date of Patent: Nov. 1, 1994

[54] APPLICATION OF FLUIDIZED MATERIAL TO A SUBSTRATE USING INTERMITTENT CHARGES OF COMPRESSED AIR

[75] Inventors: Edwin L. Cutright, Powhatan; G. Robert Scott, Midlothian; Howard W. Vogt, Jr., Providence Forge; Richard B. Reich, Midlothian, all of Va.

[73] Assignee: Philip Morris Incorporated, New York, N.Y.

[21] Appl. No.: 974,977

[22] Filed: Nov. 12, 1992

[51] Int. Cl.[5] ..... D21H 25/00

[52] U.S. Cl. ..... 162/139; 118/301; 118/416; 118/419; 118/325; 427/286; 427/424; 427/350; 427/286

[58] Field of Search ..... 427/350, 288, 382, 210, 427/286, 424; 239/8, 98, 99, 340, 344; 118/300, 301, 406, 314, 325, 419; 101/119, 127; 162/139, 135, 115

[56] References Cited

U.S. PATENT DOCUMENTS

| | | | |
|---|---|---|---|
| 2,419,365 | 4/1947 | Nagel | 239/8 |
| 3,220,653 | 11/1965 | Waldrum | 235/59 |
| 3,232,536 | 2/1966 | Davis et al. | 239/8 |
| 3,255,729 | 6/1966 | Weis | 118/212 |
| 3,421,455 | 1/1969 | Werner | 107/1 |
| 3,509,853 | 5/1970 | Hartbauer et al. | 118/411 |
| 3,537,875 | 11/1970 | Kerr | 117/18 |
| 3,567,116 | 3/1971 | Lindlof | 239/8 |
| 3,640,429 | 2/1972 | Campbell | 118/300 |
| 3,949,666 | 4/1976 | Zimmer | 101/119 |
| 4,023,487 | 5/1977 | Mitter | 101/120 |
| 4,141,505 | 2/1979 | Reich | 239/431 |
| 4,239,591 | 12/1980 | Blake | 162/109 |
| 4,357,900 | 11/1982 | Buschor | 118/682 |
| 4,846,098 | 7/1989 | Kobayashi et al. | 118/300 |
| 4,945,932 | 8/1990 | Mentzel et al. | 131/365 |
| 4,987,854 | 1/1991 | Hall | 118/300 |
| 5,229,166 | 7/1993 | Grossman et al. | 427/286 |

FOREIGN PATENT DOCUMENTS

| | | | |
|---|---|---|---|
| 2420998 | 11/1979 | France | 118/682 |

*Primary Examiner*—W. Gary Jones
*Assistant Examiner*—Brenda Lamb
*Attorney, Agent, or Firm*—Charles E. B. Glenn; James E. Schardt; Kevin B. Osborne

[57] ABSTRACT

This invention relates to the treatment of substrates with fluidized material in repetitive patterns during application cycles. The treatment patterns made with this invention can be altered by changing machine operating parameters. The patterns of fluidized material are applied to substrates using intermittent charges of compressed air. The intermittent charges of compressed air pass through a venturi slot which creates a region of low pressure in the charges adjacent to a region where the fluidized material accumulates between application cycles. This region of low pressure helps to entrain the fluidized material in the charge of compressed air. After the fluidized material is entrained in the charge of compressed air, the charge deposits the fluidized material on the substrate.

28 Claims, 5 Drawing Sheets

Microfiche Appendix Included
(071394 Microfiche, Jones; W. Gary Pages)

APPLICATION OF FLUIDIZED MATERIAL TO A SUBSTRATE USING INTERMITTENT CHARGES OF COMPRESSED AIR

BACKGROUND OF THE INVENTION

This invention relates to a method and apparatus for treating paper with other material in repetitive patterns. More particularly, the invention relates to a method and apparatus whereby repetitive treatment patterns are created without contact between the paper and the apparatus.

Methods for altering or enhancing the characteristics of paper are well known in the papermaking art. For example, many techniques have been developed for imprinting or coating paper webs. These include gravure presses, blade coating, roller coating, silkscreening and stenciling methods. Bogardy U.S. Pat. No. 4,968,534 describes a stenciling apparatus wherein a continuous stencil comes into facing engagement with a paper web during the application procedure. The apparatus includes a preparation step where air is evacuated from the web through the pattern stencil prior to the application step in order to facilitate the treatment procedure. The pattern applied by the device can be altered by changing the stencil used.

The apparatus of Bogardy U.S. Pat. No. 4,968,534 is typical of many of the other previously known treatment devices because the apparatus contacts the paper web during the application process. These previously known devices, as a result, can only be used at points in the papermaking process where the paper is sufficiently stable to withstand the contact. This limits flexibility in placement of these devices, because the devices cannot be incorporated in a papermaking machine at relatively early stages of the papermaking process.

Stenciling and other previously known methods generally transfer a predetermined pattern to a treated article. The only way to change the pattern applied is to replace the pattern-forming element of the device. In other words, there is no easy way to alter the pattern by, for instance, merely changing operating parameters. This characteristic particularly limits the applicability of these devices in mass-production situations where it is desirable to apply several patterns to paper being produced.

Another characteristic of previously known devices like that of Bogardy U.S. Pat. No. 4,968,534 is that the amount of material applied cannot be varied appreciably. In essence, since the devices are in contact with the web, there must be penetration of the web by the material during the application procedure for significant amounts of material to be applied to the web. The required penetration may not be possible depending on the combined characteristics of the paper and the treatment material, thereby resulting in less than optimum treatment of the paper.

A particular limitation of devices like that of Bogardy U.S. Pat. No. 4,968,534 is that a stenciling device incorporating a pattern for applying relatively-closely spaced bands of narrow width to cigarette paper would experience flexure of the stencil and resultant pattern nonuniformity when scaled to the size of a papermaking machine of the type used to make cigarette paper.

One other characteristic of previously known devices is that in order to maintain sufficient pressure, a sump of treatment material needs to be positioned above the stencil. This solution generally requires that sump material be recirculated to a reservoir. This constant recirculation of unused treatment material may allow contamination of the treatment material.

Improved methods for altering the characteristics of paper which overcome these limitations are of particular interest to cigarette manufacturers. Cigarette manufacturers have long appreciated the usefulness of adding flavorings or burn control additives to paper. More recently, it has been recognized that cigarette paper could be altered so that smoking articles incorporating the altered paper will have a reduced burn rate when the smoking article is not drawn on by a smoker.

Paper cigarette wrappers have burn characteristics, including burn rates and static burn capabilities. It is known that burn characteristics can be modified by adding fillers, coatings, or other additives to papers. Copending, commonly-assigned U.S. patent application Ser. No. 07/614,620, filed Nov. 16, 1990, which is hereby incorporated by reference in its entirety, includes a description of many of these methods, and also discloses a nonlaminated paper of variable basis weight and suggests that burn rate control of that paper can be achieved economically with mass-production techniques. The variable basis weight is achieved by applying bands of cellulosic slurry in a pattern to a moving paper web during production while leaving regions of the paper between the pattern untreated. The basis weight of the paper is increased in regions where the slurry has been applied, and when the paper is incorporated in a smoking article, the smoking article has a decreased burn rate in those regions. Limitations of prior mass-production application methods like that disclosed in Bogardy U.S. Pat. No. 4,968,534 render them less effective for altering the basis weight of cigarette paper in patterns as described in above-incorporated U.S. patent application Ser. No. 07/614,620.

It would be desirable to provide a method and apparatus for treating paper webs which can be easily incorporated into present papermaking machines.

It would be desirable to provide a method and apparatus for treating paper webs without contact between the paper web and the apparatus.

It would be desirable to provide a method and apparatus for applying chemical treatments to paper webs in patterns wherein the pattern applied can be altered by changing machine operating parameters.

It would be desirable to provide a method and apparatus for applying material to moving paper webs where the amount of material applied can be varied appreciably.

It would be desirable to provide a method and apparatus for applying material to moving paper webs in uniform patterns in a continuous manner, and at high speeds.

It would be desirable to provide a method and apparatus for applying material to moving paper webs where the amount of material being applied can be accurately metered, eliminating the need for recirculation of treatment material.

It would further be desirable to provide a method and apparatus for applying chemical treatments to cigarette paper so that burn rate control can be achieved economically with mass production techniques.

SUMMARY OF THE INVENTION

Accordingly, it is an object of the present invention to provide a durable apparatus which can be inexpensively manufactured and easily incorporated into a papermaking machine at various points in the papermaking process.

Another object of the present invention is to provide an apparatus which selectively applies material in a pattern to a paper web without contacting the moving paper web.

Another object of the present invention is to provide a method for treating a paper web where the pattern applied to the web can be changed by altering machine operating parameters.

Another object of this invention is to provide an apparatus in which the amount of material applied to the paper web can be varied appreciably.

Another object of the present invention is to provide an application method in which a large quantity of web is treated with material in uniform patterns, in a continuous manner, and at high speeds.

Another object of the present invention is to provide an application method where the amount of material being applied can be accurately metered, eliminating the need for recirculation of treatment material.

Another object of the present invention is to provide an application method for applying chemical treatments to cigarette paper so that burn rate control can be achieved economically with mass production techniques.

The invention comprises an apparatus and method for applying fluidized material to paper in repetitive patterns to alter the characteristics of the paper. As used herein, "fluidized material" means a substantially solid material suspended in a liquid—e.g., as a slurry—or dissolved in solution. Although in the preferred embodiment described below the invention is used for producing paper with variable burn characteristics, the invention could be used to apply many different fluidized materials to achieve differing paper characteristics. For instance, the invention could be used to apply compounds which are detectable by electromagnetic means, for use in, e.g., security applications. The invention could also be used to apply dyes, inks, or flavorings.

In a first preferred embodiment, the apparatus of this invention, a venturi slot applicator, is mounted on a papermaking machine directly over the Fourdrinier wire between the wet line and the couch roll. The venturi slot applicator comprises a rotary air valve and a feedblock. The feedblock contains an applicator slot with an inlet adjacent to the rotary air valve and an outlet adjacent to the pulp web. Slurry is pumped into the applicator slot through supply slots in communication with a slurry source. Slurry accumulates continuously on ledges in the applicator slot adjacent to the supply slots between application cycles. The ledges and surface tension of the slurry prevent the slurry from dripping out of the applicator slot prematurely between application cycles. Rotation of the rotary air valve assembly brings an outlet in the air valve adjacent to the inlet of the applicator slot at which point compressed air stored within the rotary air valve forces the slurry in the applicator slot out and onto the moving paper web. The applicator slot has a venturi region which assists in entraining the slurry in the charge of compressed air by creating a region of low pressure in the charge adjacent to the ledges where slurry accumulates between application cycles. The slurry is drawn into the charge by this region of low pressure. Continued rotation of the air valve seals the interior of the air valve, allowing additional slurry to again accumulate in the slot in preparation for the next application cycle.

In a second preferred embodiment channels in the rotary air valve are spaced in a pattern of varying angular spacings, which cause slurry to be applied to the pulp web in a pattern of varying spacings.

In a third preferred embodiment of the invention, the venturi slot applicator is incorporated in a machine to treat finished, dry paper. This alternate embodiment includes a drying means to facilitate the drying of slurry bands applied to the web.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
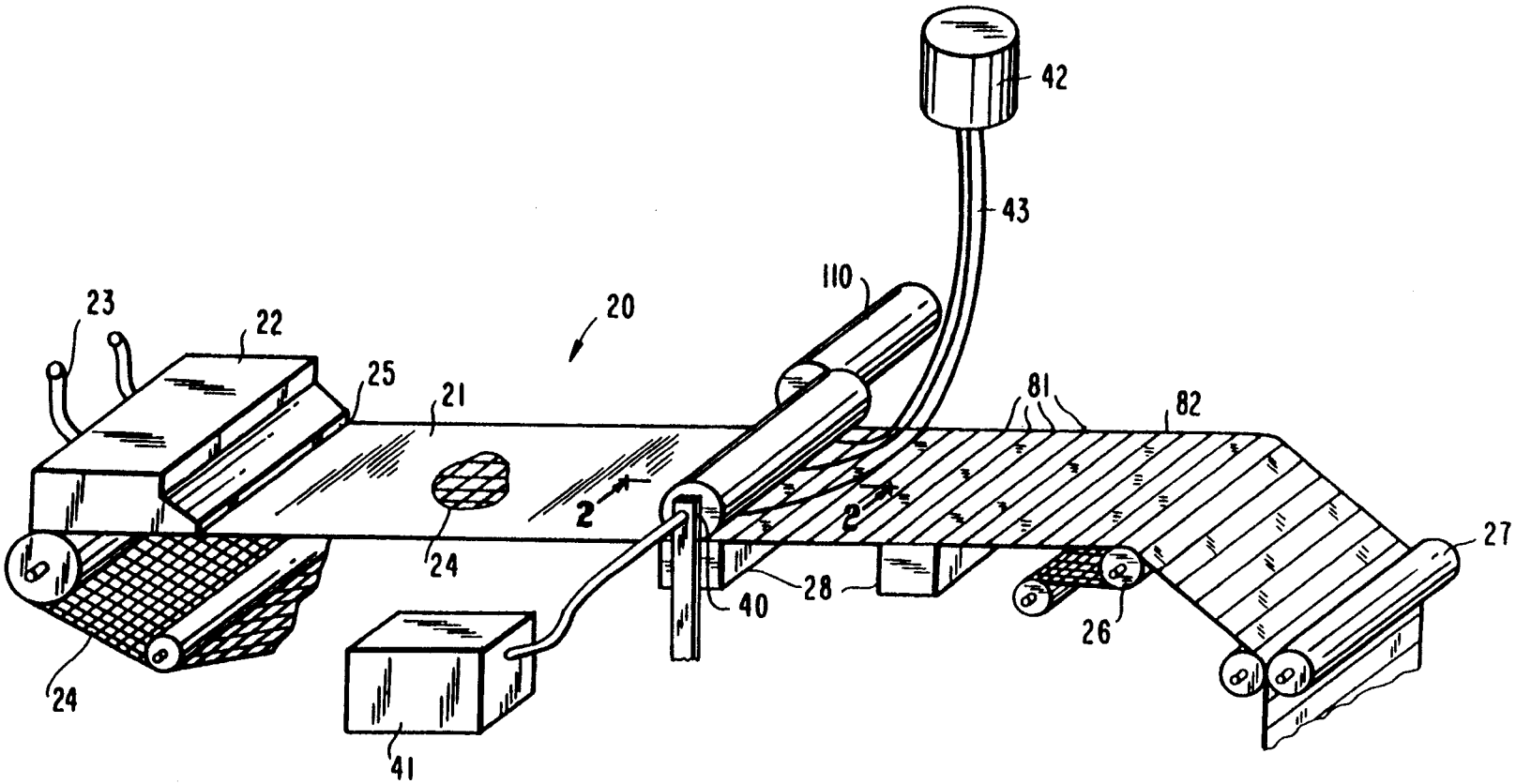
FIG. 1 is a perspective view of a paper making machine incorporating a first preferred embodiment of the present invention.

The present invention relates to a method and apparatus for altering the characteristics of paper by treating the paper during or after the production process. With this invention many different paper characteristics can be achieved. For example, materials that confer distinctive characteristics upon the paper, such as compounds which are detectable by electromagnetic means, could be applied in accordance with the invention. Inks or dyes could also be applied in accordance with the invention. The invention could also be used to apply a pattern of flavor generating material, or a pattern of electrically conductive, resistive or insulating material, for use in a flavor generating article such as that disclosed in commonly assigned U.S. Pat. No. 5,060,671. In addition, the invention could be used to treat substrates other than paper. Although the first preferred embodiment of the invention relates to treatment of cigarette paper, it will be apparent that the invention has many applications.

The first preferred embodiment of the invention is a method and apparatus for altering the basis weight of cigarette paper in select regions so that burn rate characteristics are altered in those regions. As used herein, "base web" refers to untreated regions of paper and "treated regions" are the regions of increased basis weight which are created in the base web by applying slurry in an application pattern.

An increase in basis weight of localized regions in a paper web may be achieved by increasing either the thickness, the density, or both in those regions. The increase in basis weight may be accomplished by depositing, onto an existing pulp web in a papermaking machine, additional fluidized material such as a second quantity of cellulosic pulp, or, alternatively, a filler material. As used herein, "fluidized material" means a substantially solid material suspended in a liquid—e.g., as a slurry—or dissolved in solution. Some examples of additional materials are highly refined cellulosic pulp, high surface area cellulosic fibers such as cellulon, microcrystalline cellulose such as Avicel or a mixture of highly refined pulp and calcium carbonate. Other insoluble, cellulose-compatible materials could also be used, such as amylopectin or certain modified celluloses.

The treated regions made in accordance with this invention have a basis weight above that of the base web. When paper made with the present invention is incorporated in a smoking article, the smoking article will have variable burn rate characteristics. For example, the static burn rate of the smoking article may be substantially decreased during combustion of treated regions, because regions of increased basis weight have decreased porosity. The rate of oxygen diffusion through the paper in these regions is thereby decreased, retarding combustion of the smoking article.

The dimensions of the treated regions may also affect the burn characteristics of the paper and, consequently, a smoking article incorporating the paper. When the paper is incorporated in a cigarette, the treated regions form a series of rings of known width and separation along the longitudinal axis of the cigarette. Both the width of, and the degree of separation between, these rings of treated paper have a substantial effect on the overall burn rate of the smoking article. The width and degree of separation of the rings effectively determine what percentage of the smoking article will experience a burn rate decreased from the nominal rate associated with the base web.

The present invention provides a method and apparatus for applying slurry in any desired application pattern to form treated regions. The invention also allows the application pattern to be changed by adjustment of machine operating parameters, to alter, e.g., the size and spacing of the treated regions comprising the application pattern. This allows the same machine to make papers with differing variable burn rate characteristics.

A first preferred embodiment of the apparatus of this invention is shown in FIG. 1, which depicts the pulp web-forming area of a conventional Fourdrinier papermaking machine 20, adapted to produce a continuous pulp web 21. A headbox 22 contains a quantity of cellulosic pulp which is supplied to headbox 22 by a plurality of conduits 23 which communicate with a pulp source, such as a pulp storage tank (not shown).

Immediately below headbox 22 is an endless forming wire 24. A slice 25 defined in a lower portion of headbox 22 adjacent to wire 24 permits the pulp from the headbox 22 to flow through slice 25 onto the top surface of the wire 24 to form pulp web 21. Slice 25 is usually narrow in height in order to regulate the amount of pulp which flows from headbox 22. Slice 25 typically may extend substantially across the entire width of pulp web 21.

The top portion of wire 24 is adapted to move forwardly toward a couch roll 26 and away from slice 25. The direction from headbox 22 toward couch roll 26 is defined as the downstream direction. Once pulp web 21 has been formed, it passes under the apparatus of this invention—i.e., the venturi slot applicator 40—which deposits additional fluidized material onto pulp web 21 with intermittent charges of compressed air.

Compressed air is supplied to venturi slot applicator 40 from an air compressor 41. The fluidized material is pumped under pressure from a storage tank 42 through a plurality of conduits 43 to the venturi slot applicator 40.

Figure 2:
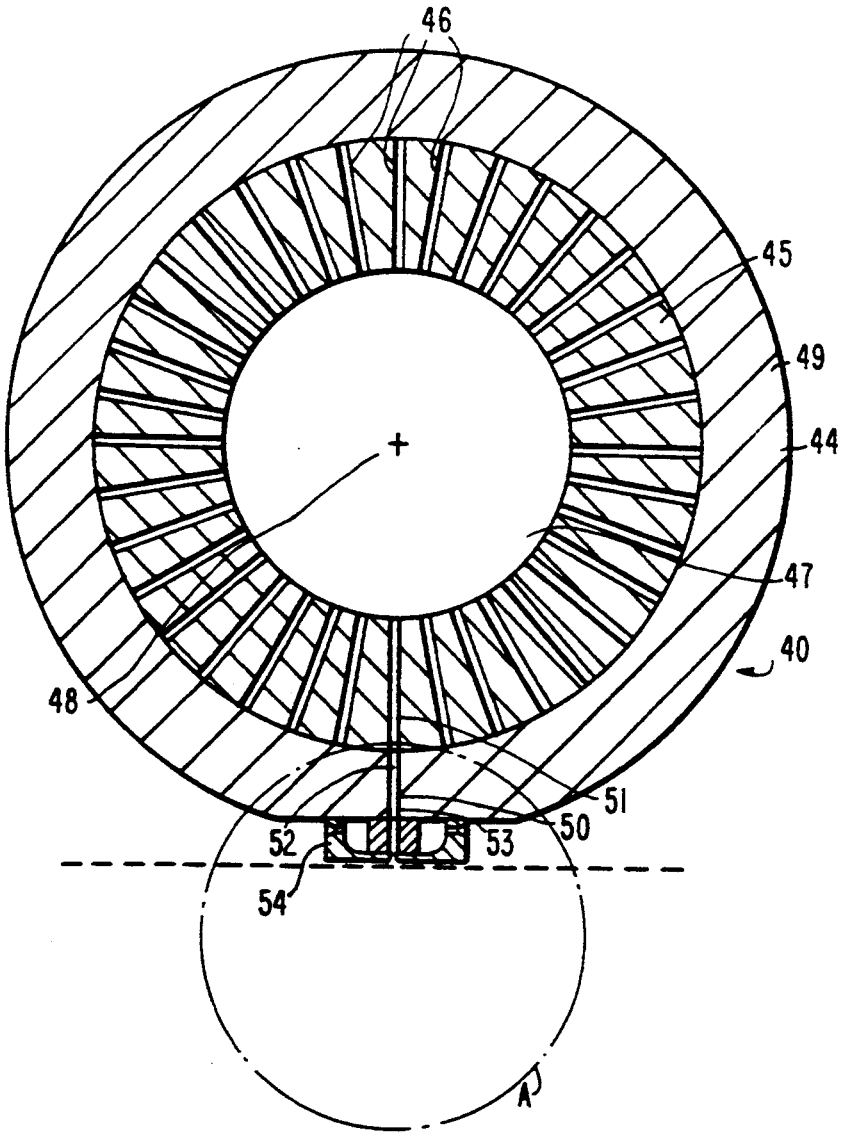
FIG. 2 is a vertical cross-sectional view of a venturi slot applicator in accordance with the invention, taken along line 2—2 of FIG. 1.
Figure 3:
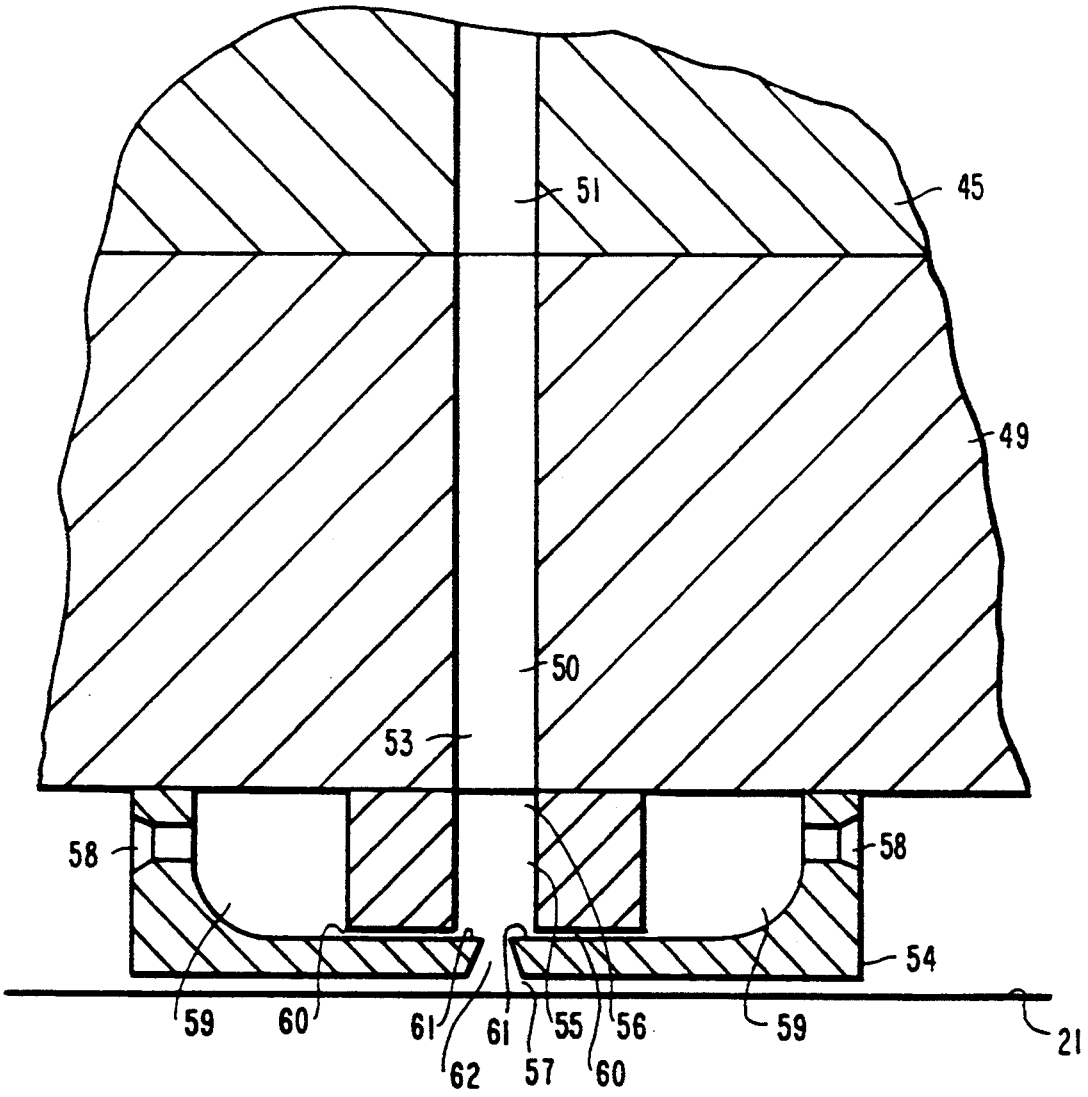
FIG. 3 is an enlarged view of area A of FIG. 2.

As shown in the cross-sectional views of FIGS. 2 and 3, the venturi slot applicator 40 includes a rotary air valve 44, although other sources of intermittent charges of compressed air may be used. The rotary air valve 44 comprises several elements including rotor and stator elements. The rotor element comprises a rotary air valve drum 45. The rotary air valve drum 45 is cylindrical in shape and hollow. Machined into the surface of the rotary air valve drum 45 are a plurality of radial channels 46 which are in communication with the hollow interior 47 of the rotary air valve drum 45, and which extend parallel to the axis 48 of the rotary air valve drum 45. In FIG. 2, the channels 46 are equiangularly spaced about the periphery of rotary air valve drum 45. The channels 46 may also be arranged in a pattern of varying angular spacings. Hollow interior 47 of rotary air valve drum 45 is connected to the air compressor 41 of FIG. 1 which supplies the rotary air valve 44 with compressed air.

Rotary air valve drum 45 is mounted within stationary rotary air valve vessel 49, which serves as the stator element. Rotary air valve vessel 49 is also cylindrical in shape, and has a single radial channel 50 extending parallel to the axis 48 of the rotary air valve vessel 49, and the rotary air valve drum 45.

Rotary air valve drum 45 is adapted for rotation at a constant angular velocity by conventional drive means 110, which may be any number of motors and drive trains familiar to those skilled in the art. Rotation of rotary air valve drum 45 brings channels 46 in rotary air valve drum 45 sequentially into alignment with channel 50 in rotary air valve vessel 49. This allows a charge of compressed air to pass from hollow interior 47 of rotary air valve drum 45 through that one channel 51 of channels 46 in alignment with channel 50 and then through inlet 52 of channel 50.

The outlet 53 of channel 50 is adjacent to feedblock 54. Machined into feedblock 54 is an applicator slot 55, which is parallel to channel 50. Applicator slot 55 has a substantially rectangular cross-section in any plane parallel to the plane of pulp web 21. Inlet end 56 of the applicator slot 55 is in permanent alignment with channel 50. Outlet end 57 of slot 55 is adjacent to moving pulp web 21 which passes immediately below feedblock 54.

Feedblock 54 also has a plurality of slurry inlets 58. Through these slurry is supplied to the feedblock from the storage tank 42 of FIG. 1. Slurry from inlets 58 flows into cavity reservoirs 59 and applicator slot 55. Cavity reservoirs 59 communicate with applicator slot 55 through supply slots 60. The size of supply slots 60 and the slurry supply pressure regulate the amount of slurry flowing into the applicator slot 55. The slurry flowing into applicator slot 55 flows onto ledges 61 in the applicator slot 55. These ledges are associated with the beginning of a venturi region 62 in the applicator slot. The slurry remains on ledges 61 between application cycles due to surface tension. As shown, the width of the applicator slot 55 is at a minimum in the venturi region 62 and then the width increases again.

Application cycles are initiated by alignment of channel 51 in rotary air valve drum 45 with channel 50 in rotary air valve vessel 49. This alignment allows a charge of compressed air to flow from hollow interior 47 of rotary air valve drum 45 and into channel 50. This charge travels down channel 50 and into applicator slot 55. When the charge of compressed air encounters the venturi region 62, its velocity increases. This velocity increase is accompanied by a decrease in pressure. This decrease in pressure occurs adjacent to the ledges 61 where the slurry has been accumulating between application cycles, and assists in entraining the slurry in the charge of compressed air. After passing through the venturi region 62 the charge of compressed air with entrained slurry exits the applicator slot 55 and impacts the pulp web 21, depositing the entrained slurry onto the pulp web 21.

Continued rotation of rotary air valve 45 moves channel 51 out of alignment with channel 50, thus temporarily removing the source of compressed air. This interruption allows slurry to accumulate in the applicator slot 55 in preparation for the next application cycle.

Referring again to FIG. 1, repeated application cycles cause a series of bands 81 to be applied to the pulp web 21. These bands are substantially rectangular, corresponding to the shape and exit dimensions of the applicator slot 55. These bands 81 preferably are substantially parallel to one another and equally spaced and form the application pattern 82 which alters the characteristics of the pulp web 21. As described above, the pressure of material supplied to the applicator slot 55 is variable, allowing control of the amount of material applied in the individual bands 81.

The intervals between bands 81 may also be varied by altering the angular velocity of the rotary air valve drum 45. Slowing the drum, for instance, would result in bands 81 being further apart, while accelerating the drum would result in bands 81 being closer together. Continually altering the angular velocity of drum 45 allows one to create a pattern of unequally spaced bands 81.

In the preferred embodiment, the bands 81 are applied perpendicular to the direction of travel of the pulp web 21. The bands can also be applied at an oblique angle by pivoting the venturi slot applicator 40 in a plane parallel to the plane of the pulp web 21 so that the applicator slot 50 is at an oblique angle to the direction of travel of the pulp web 21.

Figure 4:
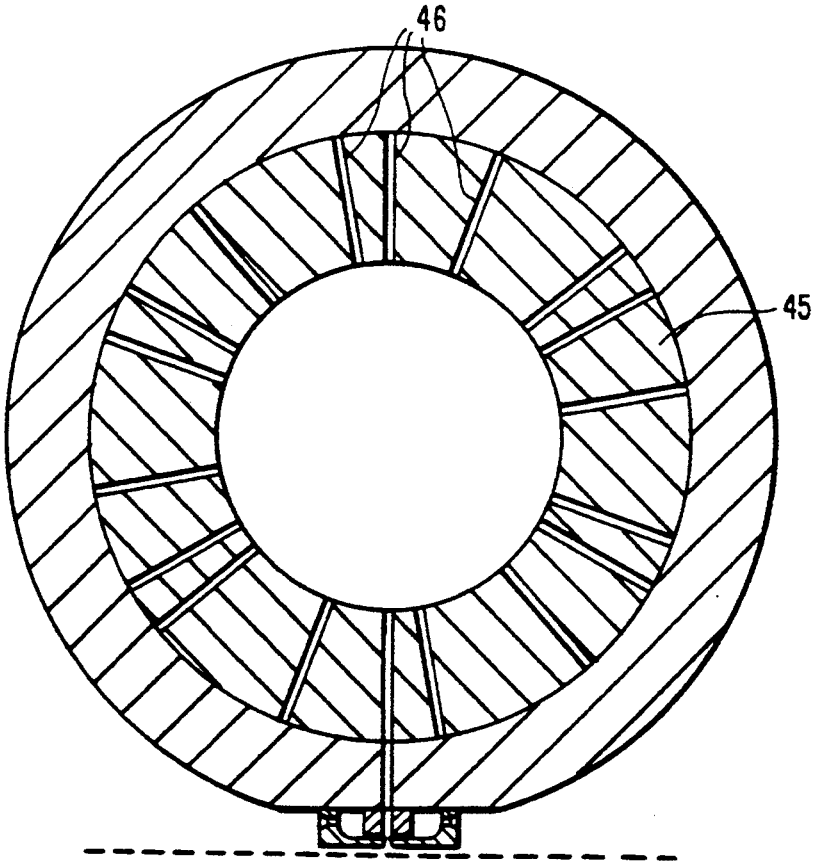
FIG. 4 is a vertical cross-sectional view of a second preferred embodiment of the invention.

In a second preferred embodiment bands 81 may also be applied in a repetitive pattern of varying spacings by employing a rotary air valve drum 45 with channels 46 arranged in a repetitive pattern of varying angular spacings, as shown in FIG. 4, preferably operating at constant angular velocity.

Other patterns may be applied with the venturi slot applicator by constructing a feedblock 51 with a slot (not shown) having a different cross-section in a plane parallel to the pulp web 21. For instance, if the slot had a circular cross-section, a series of circular regions of fluidized material could be applied to pulp web 21.

After the venturi slot applicator 40 has applied the application pattern 82 to the pulp web 21, the web continues to move in a downstream direction. As wire 24 begins to move downwardly about couch roll 26 and back toward headbox 22, pulp web 21 is delivered from wire 24 to a plurality of press rolls 27 and then to a conventional dryer section of papermaking machine (not shown). As pulp web 21 advances in the downstream direction, excess water is permitted to pass through wire 24. Vacuum boxes 28 may be applied to portions of the underside of wire 24 to assist in the removal of water from pulp web 21. Locating a vacuum box 28 underneath wire 24 at the application point assists the application process by assisting penetration and reducing splashback. Couch roll 26 may be adapted to provide a vacuum through wire 24 to the underside of pulp web 21 to remove additional water.

Figure 5:
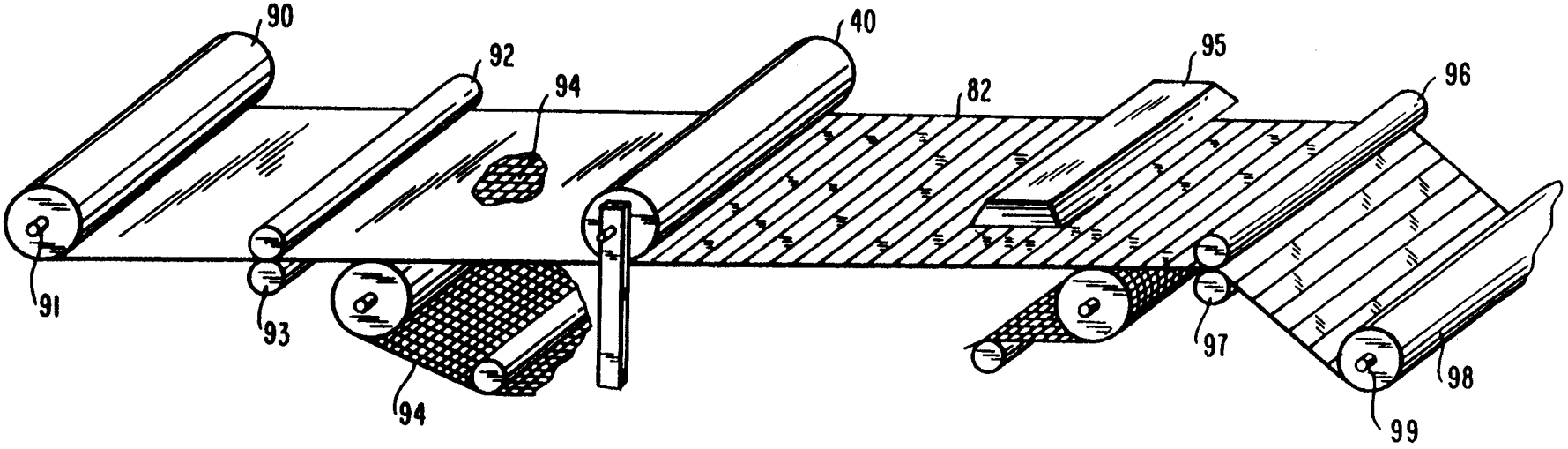
FIG. 5 is a perspective view of a third preferred embodiment of the invention.

In a third preferred embodiment of the invention, shown in FIG. 5, the venturi slot applicator 40 has been incorporated in a machine to treat premanufactured paper. The machine has a roll of premanufactured paper 90 mounted on a feedshaft 91. The paper on the roll 90 is fed between an upper idler 92 and a lower idler 93 and onto a continuous moving web 94. A continuous moving web may not be needed, depending on paper strength. For example, the paper may be supported by a shoe (not shown) familiar to those skilled in the art. The venturi slot applicator is mounted above the continuous moving web 94 which is supporting the paper 90 to be treated. After the application pattern 82 has been applied to the paper 90 by the venturi slot applicator 40, the paper moves underneath a dryer 95. A number of types of drying means familiar to those skilled in the art including felt absorption, heated drums and infrared drying may be used. After the application pattern 82 has been dried by the dryer 95, the paper moves between the final upper idler 96 and final lower idler 97. The paper 90 is then taken up by a take-up roll 98 mounted on a take-up shaft 99.

Thus it is seen that an apparatus and method for treating paper in repetitive patterns where the repetitive patterns are made without contact between the apparatus and paper and where the patterns applied can be altered by changing apparatus operating parameters is provided. One skilled in the art will appreciate that the present invention can be practiced by other than the described embodiments, which are presented for purposes of illustration and not of limitation, and the present invention is limited only by the claims that follow.

What is claimed is:

1. An apparatus for applying a fluidized material to a web in a series of application cycles, comprising:

means for moving said web along a path in a direction of travel;

applicator means for holding said fluidized material adjacent to said web, said applicator means having an open first slot, said slot having an inlet for admitting a charge of compressed air during each of said application cycles, and having an outlet adjacent to said web, said charge of compressed air traveling toward said outlet;

accumulator means associated with said slot for accumulating said fluidized material in an accumulation region between each of said application cycles, said accumulator means including an open supply slot continuously communicating said accumulation region with said open first slot;

said open first slot including a venturi at a location between said inlet and said outlet of said first slot, said venturi creating a region of low pressure in said charge of compressed air adjacent to said accumulation region, thereby withdrawing fluidized material from said accumulation region through said supply slot responsively to said charge of compressed air and entraining said withdrawn fluidized material in said charge of compressed air, said charge of compressed air exiting said slot through said outlet and depositing said fluidized material entrained in said charge on said web during each of said application cycles;

supply means for continuously supplying said applicator means with said fluidized material under pressure; and charge means for supplying said applicator means with said charge of compressed air during each of said application cycles.

2. The apparatus of claim 1, wherein said web comprises a paper web.

3. The apparatus of claim 2, wherein said fluidized material comprises a slurry to alter burn rate characteristics of said paper web.

4. The apparatus of claim 1, wherein said first slot is rectangular in cross section in a plane parallel to a plane of said web, whereby said fluidized material applied to said web during said application cycles forms a series of substantially rectangular substantially parallel bands of said fluidized material on said web.

5. The apparatus of claim 4, wherein said first slot is oriented at an angle perpendicular to said direction of travel of said web, whereby said bands of said fluidized material applied to said web are perpendicular to said direction of travel of said web.

6. The apparatus of claim 4, wherein said first slot is oriented at an oblique angle to said direction of travel of said web, whereby said bands of said fluidized material applied to said web are at an oblique angle to said direction of travel of said web.

7. The apparatus of claim 1, wherein said application cycles occur at equal time intervals whereby said fluidized material is applied at equally spaced intervals along said web.

8. The apparatus of claim 7 wherein the linear measure of said equally spaced intervals can be varied by changing the duration of said equal time intervals to a new value.

9. The apparatus of claim 1, wherein said application cycles occur in a repetitive pattern of varying time intervals whereby said fluidized material is applied in a repetitive pattern of varying spacings along said web.

10. The apparatus of claim 1 wherein said pressure of said fluidized material is variable, whereby the amount of said fluidized material accumulating in said first slot between said application cycles and being discharged during said application cycles is variable.

11. A venturi slot applicator for applying a fluidized material to a moving web during application cycles, while said moving web passes underneath said venturi slot applicator in a direction of travel, comprising:

a feedblock positioned above said moving web, said feedblock having an applicator slot and at least one supply slot, said feedblock having at least one cavity reservoir for holding said fluidized material, said at least one cavity reservoir communicating with said applicator slot through said at least one supply slot, said feedblock having at least one orifice for admitting said fluidized material into said at least one cavity reservoir; wherein:

said applicator slot has an inlet for admitting a charge of compressed air during each of said application cycles, said applicator slot having at least one ledge adjacent to said at least one supply slot for accumulating said fluidized material between each of said application cycles, said applicator slot having a venturi region adjacent to said at least one ledge, width of said applicator slot decreasing to a minimum in said venturi region and then increasing again, said applicator slot having an outlet above said web; said venturi slot applicator further comprising:

supply means for continuously supplying said fluidized material to said orifice of said feedblock under pressure, said pressure of said fluidized material forcing said fluidized material through said cavity reservoir and supply slot and into said applicator slot;

a rotary air valve comprising a rotor and a stator, said rotor and stator cylindrical in cross section and hollow, said rotor mounted coaxially within said stator, said rotor and stator having a common axis; wherein:

said rotor has an outer surface with at least one channel machined in said outer surface and extending through to said hollow interior of said rotor, said at least one channel parallel to said common axis, said rotor adapted for rotation; and said stator has an outer surface and an inner surface, said inner surface abutting and covering said outer surface of said rotor, said stator having a channel machined in said outer surface of said stator, said channel extending through to said hollow interior of said stator, said channel parallel to said common axis, said channel having an inlet adjacent to said rotor and an outlet adjacent to said inlet of said applicator slot; said venturi slot applicator further comprising:

compressed air supply means for supplying compressed air to said hollow interior of said rotor;

drive means for rotating said rotor at an angular velocity, said drive means bringing said at least one channel in said rotor into periodic alignment with said channel in said stator during each of said application cycles, allowing a charge of compressed air to travel from said hollow interior of said rotor through said channels in said rotor and said stator into said applicator slot, said venturi region creating a region of low pressure in said charge of compressed air, thereby entraining said fluidized material on said at least one ledge in said charge of compressed air, said charge of compressed air discharging said material entrained in said charge through said outlet of said applicator slot and onto said moving web.

12. The venturi slot applicator of claim 11, wherein said moving web comprises a moving paper web.

13. The venturi slot applicator of claim 12, wherein said fluidized material comprises a slurry to alter burn rate characteristics of said moving paper web.

14. The venturi slot applicator of claim 11, wherein said slot is rectangular in shape in a plane parallel to the plane of said moving web, whereby said fluidized material applied to said moving web during said application cycles forms a series of parallel rectangular bands of said fluidized material on said moving web.

15. The venturi slot applicator of claim 14, wherein said slot is oriented at an angle perpendicular to said direction of travel of said moving web, whereby said bands of said fluidized material applied to said moving web are perpendicular to said direction of travel of said moving web.

16. The venturi slot applicator of claim 14, wherein said slot is oriented at an oblique angle to said direction of travel of said moving web, whereby said bands of said fluidized material applied to said moving web are at an oblique angle to said direction of travel of said moving web.

17. The venturi slot applicator of claim 11 wherein said channels in said rotor element occur at regular angular intervals and said angular velocity of said rotor element is constant whereby said fluidized material is applied at equally spaced intervals along said moving web.

18. The venturi slot applicator of claim 17 wherein said angular velocity of said rotor element is variable over a range of angular velocities whereby said equally spaced intervals are variable over a range of linear spacings.

19. The venturi slot applicator of claim 11 wherein said channels in said rotor element occur in a repetitive pattern of angular spacings and said angular velocity of said rotor element is constant whereby said fluidized material is applied in a repetitive pattern of varying linear spacings along said moving web.

20. A method of applying spaced-apart transverse bands of fluidized material onto a web, said method comprising the steps of:

moving a web along a first path;

at a location along said path discharging a fluidized material repetitively from a slotted outlet extending transversely across said web path, said discharging step comprising the steps of:

including a venturi with said slotted outlet;

accumulating fluidized material in proximate relation along said slotted outlet while maintaining open communication between said accumulating fluidized material and said venturi of said slotted outlet through a supply slot, said slotted outlet remaining open during said accumulating step;

repetitively drawing a predetermined amount of said accumulating fluidized material through said supply slot and out said slotted outlet onto said web by repetitively discharging a charge of compressed gas through said venturi and said slotted outlet.

21. The method of claim 20, wherein said web comprises a paper web.

22. The method of claim 21, wherein said fluidized material comprises a slurry for altering burn rate characteristics of said paper web.

23. The method of claim 22, wherein said fluidized material is discharged onto said web in an application pattern comprising a series of treated regions.

24. The method of claim 23 wherein said series of treated regions comprises a plurality of substantially rectangular bands substantially parallel to one another.

25. The method of claim 24, wherein said bands of said fluidized material applied to said web are perpendicular to said direction of travel of said web.

26. The method of claim 24, wherein said bands of said fluidized material applied to said web are at an oblique angle to said direction of travel of said web.

27. The method of claim 22, further comprising the step of applying a vacuum to said web after said fluidized material has been applied to said web.

28. The method of claim 27, further comprising the step of drying said web after said fluidized material has been applied to said web.

* * * * *